US011291092B2

(12) United States Patent
Xing et al.

(10) Patent No.: US 11,291,092 B2
(45) Date of Patent: Mar. 29, 2022

(54) PWM DIMMING CIRCUIT WITH LOW STAND-BY POWER

(71) Applicant: Consumer Lighting (U.S.), LLC, Norwalk, CT (US)

(72) Inventors: Dong Xing, Shanghai (CN); Aijun Wang, Shanghai (CN); Weihu Chen, Shanghai (CN); Xin Zhou, Shanghai (CN); Fanbin Wang, Shanghai (CN)

(73) Assignee: Savant Technologies LLC, East Cleveland, OH (US)

( * ) Notice: Subject to any disclaimer, the term of this patent is extended or adjusted under 35 U.S.C. 154(b) by 0 days.

(21) Appl. No.: 16/798,292

(22) Filed: Feb. 21, 2020

(65) Prior Publication Data

US 2020/0329542 A1 Oct. 15, 2020

(30) Foreign Application Priority Data

Apr. 12, 2019 (CN) ..... 201910295648.9

(51) Int. Cl.
*H05B 47/19* (2020.01)
*H05B 45/325* (2020.01)
*H05B 47/195* (2020.01)

(52) U.S. Cl.
CPC ..... *H05B 45/325* (2020.01); *H05B 47/195* (2020.01)

(58) Field of Classification Search
CPC ..... H05B 33/0815; H05B 33/0839; H05B 33/0845; H05B 33/0863; H05B 45/0325; H05B 45/395; H05B 47/19; H05B 47/195
USPC ..... 315/297, 307
See application file for complete search history.

(56) References Cited

U.S. PATENT DOCUMENTS

| | | | | |
|---|---|---|---|---|
| 8,723,437 | B1 * | 5/2014 | Wang | H05B 45/37 315/224 |
| 9,717,123 | B1 * | 7/2017 | Yao | H05B 45/10 |
| 2008/0224636 | A1 * | 9/2008 | Melanson | H05B 45/38 315/307 |
| 2012/0217889 | A1 * | 8/2012 | Jayabalan | H05B 45/14 315/209 R |
| 2013/0082624 | A1 * | 4/2013 | Brassfield | H05B 45/14 315/297 |
| 2013/0099694 | A1 * | 4/2013 | Naruo | H05B 45/3725 315/224 |
| 2016/0212815 | A1 * | 7/2016 | Watanabe | H05B 45/375 |
| 2016/0309554 | A1 * | 10/2016 | Kang | H05B 45/10 |
| 2017/0302170 | A1 * | 10/2017 | Reed | H05B 45/37 |

* cited by examiner

*Primary Examiner* — Tung X Le
(74) *Attorney, Agent, or Firm* — Wood IP LLC

(57) ABSTRACT

The present disclosure relates to PWM dimming circuit with low stand-by power. A lighting apparatus driver is provided, comprising: a power supplier to supply power to a lighting load; and a discrete PWM dimming circuit, the PWM dimming circuit is to receive PWM signal, and to control the switching of the power supplier based on the PWM signal, wherein the power supplier is capable of being turned off by the PWM dimming circuit.

20 Claims, 5 Drawing Sheets

PWM DIMMING CIRCUIT WITH LOW STAND-BY POWER

FIELD

The present techniques relate generally to LED lighting. More specifically, the present techniques relate generally to PWM dimming circuit with low stand-by power.

BACKGROUND

In recent years, as the LED (Light Emitting Diodes) lighting technology develops, LED is becoming one of mainstream lighting applications, and more and more LED light sources are replacing traditional light sources. As light source, LED is known to have many advantages, such as small size, high luminous efficiency, low energy consumption, and long longevity, and so on.

Another reason that makes LED popular is the convenience and flexibility of LED dimming, since LED is driven and controlled in a relatively simple manner. Among the various existing LED dimming approaches, pulse width modulation (PWM) dimming is one of the most commonly used method, which realizes LED dimming by controlling the duty ratio of PWM signal (pulse train) sent to the LED driver.

FIG. 1 illustrates one exemplary system to realize PWM dimming (analog diming) for LED in the prior art. A controller 105, which may be embodied as smart phone, speaker, cloud, or router, sends out a dimming signal to the wireless module 104. This dimming signal instructs a PWM generator to generate a PWM signal with certain duty ratio, which is further to be received and processed by a circuit (such as reference circuit, signal processing circuit) to obtain a reference signal. After receiving this reference signal, a LED driver 102 (typically AC/DC circuit with dimming function) controls the power output to LED 101 according to this reference signal. By adjusting the duty ratios of PWM signals sent to the LED driver under the control of the controller 105, the power output to LED 101 by driver 102 can be controlled, resulting in different LED brightness.

FIG. 2 illustrates another exemplary system to realize digital diming for LED in the prior art. Briefly, a controller 205, such as a smart phone, etc, sends a digital signal to the driver 202 (typically AC/DC circuit with dimming function) for LED 201 through the wireless module 204. This digital signal "informs" the driver 202 of the power sent to the LED 201. By using digital dimming approach, more different levels of light output can be realized. Meanwhile, digital dimming for LED only requires quite simple operation from user. However, it requires relatively expensive digital chip to realize its digital dimming function, which increases the cost of the lighting apparatus.

Currently, as smart and green lighting market is growing up rapidly, there are more demands for low cost and low stand-by power driver. However, in the prior art techniques as presented above, when the LED apparatus is in a soft turning-off mode, the LED driver 102 or 202 that integrates the PWM dimming function or digital dimming function and power supplier into a single chip, as described above in conjunction with FIG. 1 and FIG. 2, will not be virtually turned off, since the driver chip still needs to work to maintain some function(s) integrated thereon. In other words, when the LED apparatus is in a soft turning-off mode, there is still substantial power consumption on the driver chip, and this is not "green" enough. On another aspect, this kind of driver chip has a relatively high cost.

Therefore, a more environment-friendly and low-cost solution for LED dimming is desired.

SUMMARY

An objective of the embodiments of present disclosure is to provide a more environment-friendly and low-cost lighting apparatus driver.

In a first aspect of present disclosure, a lighting apparatus driver is provided, comprising: a power supplier to supply power to a lighting load; and a discrete PWM dimming circuit, the PWM dimming circuit is to receive PWM signal, and to control the switching of the power supplier based on the PWM signal, wherein the power supplier is capable of being cut off by the PWM dimming circuit. In one embodiment of the present disclosure, the power supplier is non-PWM-dimmable. The dimming circuit may be connected in series with the power supplier. The power supplier is to be cut off by the dimming circuit when the PWM signal is zero. Therefore, the power consumption of the power supplier is zero when the PWM signal is zero. The dimming circuit may be based on Metal Oxide Semiconductor Field Effect Transistor (MOSFET) or triode. Further, during working mode indicated by an external control signal from external controller, the power supplier is to supply predetermined power output with an amplitude being controlled by PWM signal to the lighting load; and during soft turning-off mode indicated by the external control signal from external controller, the power supplier is to be cut off by the dimming circuit, such that the power consumption of the power supplier is zero.

In another aspect of present disclosure, a lighting apparatus driver is provided, comprising: a power supplier to supply power to a lighting load; and a discrete dimming circuit, the dimming circuit is to receive dimming input signal, and to control the switching of the power supplier based on the dimming input signal, wherein the power supplier is capable of being cut off by the dimming circuit when the lighting apparatus driver is still being connected to power source. The power supplier itself is non-dimmable. The dimming circuit may be connected in series with the power supplier. The power consumption of the power supplier is zero when the dimming input signal is zero. The dimming circuit may be based on MOSFET or triode.

This summary is intended to provide an overview of the subject matter described in this disclosure. It is not intended to provide an exclusive or exhaustive explanation of the apparatus and/or methods described in detail within the accompanying drawings and description below. The details of one or more aspects of the disclosure are set forth in the accompanying drawings and the description below.

BRIEF DESCRIPTION OF THE DRAWINGS

The present disclosure can be better understood in light of description of embodiments of the present disclosure with reference to the accompanying drawings, in which.

DETAILED DESCRIPTION

Figure 1:
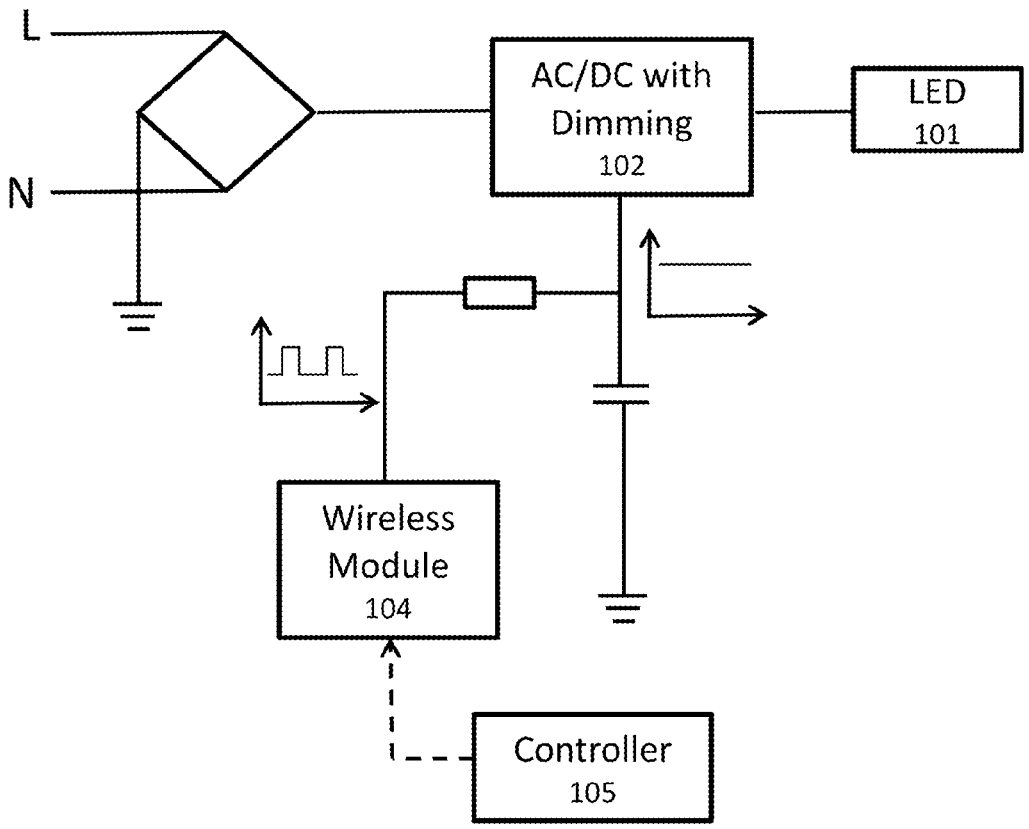
Prior Art FIG. 1
FIG. 1 illustrates one exemplary system to realize PWM dimming (analog diming) for LED in the prior art.
Figure 2:
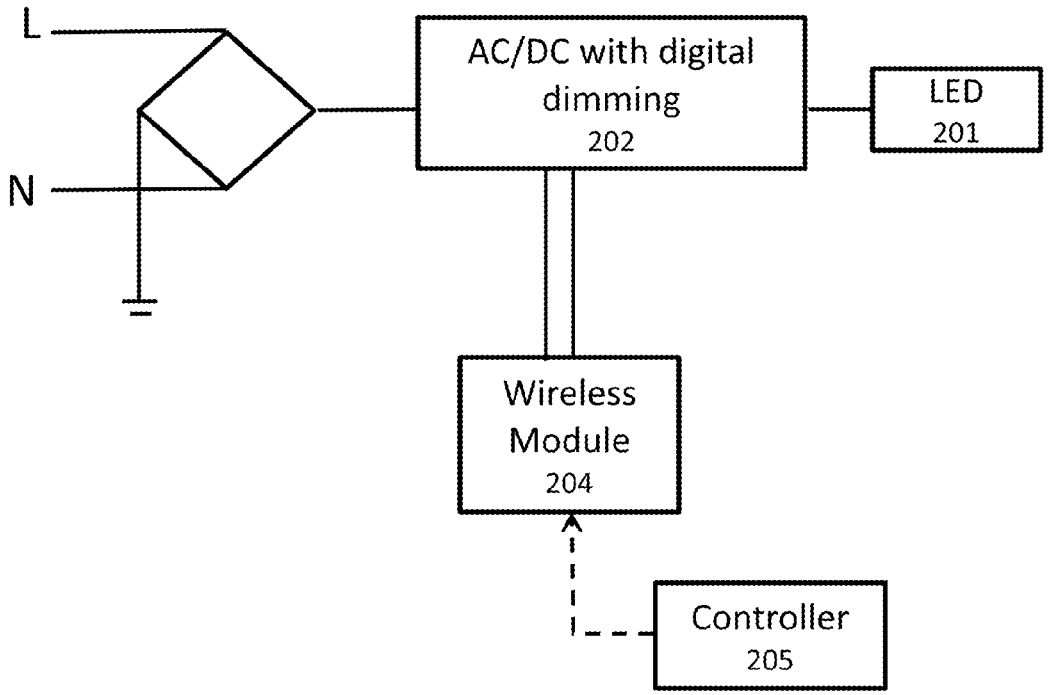
Prior Art FIG. 2
FIG. 2 illustrates another exemplary system to realize digital diming for LED in the prior art.

Unless defined otherwise, the technical or scientific terms used herein should have the same meanings as commonly understood by one of ordinary skilled in the art to which the present disclosure belongs. The terms "first", "second" and the like in the Description and the Claims of the present application for disclosure do not mean any sequential order, number or importance, but are only used for distinguishing different components. Likewise, the terms "a", "an" and the like do not denote a limitation of quantity, but denote the existence of at least one. The terms "comprises", "comprising", "includes", "including" and the like mean that the element or object in front of the "comprises", "comprising", "includes" and "including" covers the elements or objects and their equivalents illustrated following the "comprises", "comprising", "includes" and "including", but do not exclude other elements or objects. The terms "coupled", "connected" and the like are not limited to being connected physically or mechanically, but may comprise electric connection, no matter directly or indirectly.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in the figures of present disclosure, the elements in some cases may each have a same reference number or a different reference number to suggest that the elements represented could be different and/or similar. However, an element may be flexible enough to have different implementations and work with some or all of the systems shown or described herein. The various elements shown in the figures of present disclosure may be the same or different. Which one is referred to as a first element and which is called a second element is arbitrary.

Existing solutions for LED dimming are adopting PWM dimming integrated circuit (IC) for linear/buck/buck-boost driver. Such solution will lead to high BOM cost, and the stand-by power of the IC cannot be lowered down, because the IC will remain working during soft turning off mode.

To reduce the stand-by power and BOM cost of the lighting apparatus, in this disclosure, a simplified PWM dimming circuit is provided.

Figure 3:
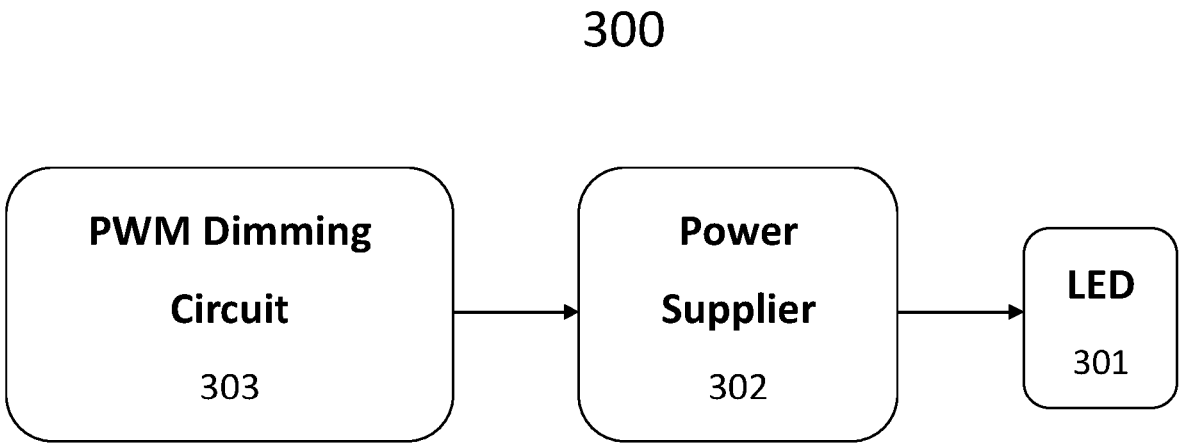
FIG. 3 illustrates one exemplary lighting apparatus 300 to realize PWM dimming for LED in accordance with one embodiment of present invention.

FIG. 3 illustrates one exemplary lighting apparatus 300 to realize PWM dimming for LED in accordance with one embodiment of present invention. As can be seen from a non-limiting embodiment illustrated in FIG. 3, the lighting apparatus 300 may comprise: a lighting load 301, including but not limited to a LED load 301; a power supplier 302, which is to be connected to the lighting load 301, and is to supply power to the lighting load 301; a discrete PWM dimming circuit 303, which is to be connected to the power supplier 302. The discrete PWM dimming circuit 303 has a main function of PWM switching for the power supplier 302 according to PWM signal.

The power supplier 302 in FIG. 3 can be a switching mode power supplier (such as Buck, Buck-Boost, Fly-back, etc), or a linear circuit, or any constant current controlled LED driver that may be used in the field. That is to say, the power supplier is a power regulator (switching regulator or linear regulator, or any other suitable regulator) to provide predetermined power output to the lighting load 301. In a preferred embodiment of the present disclosure, the power supplier 302 is non-PWM-dimmable, i.e., one or more components/circuits used to control PWM dimming for the LED load 301 is not integrated with, or within the circuit of the power supplier 302.

According to one embodiment of the present application, a discrete PWM dimming circuit 303 is used to control PWM dimming for the LED load 301. In other words, the PWM dimming circuit 303 according to present disclosure is separated from (non-integrated with) the power supplier 302. In one embodiment of present disclosure, the dimming circuit 303 may be based on MOSFET or triode, or any other components that can function as a switch circuit. In a detailed embodiment of the present application, the dimming circuit 303 may be connected in series with the power supplier 302.

The power supplier 302 and the discrete PWM dimming circuit 303 may be collectively regarded as a lighting apparatus driver for the LED load 301. However, this kind of lighting apparatus driver is different from the existing driver for LED which integrates at least the power supplier 302 and the PWM dimming circuit 303 on a single IC or chip. The power supplier 302 and the discrete PWM dimming circuit 303 of the present disclosure are capable of working together to change the power output to the LED load 301, so as to dim the LED load 301. In one embodiment of the present application, the PWM dimming circuit 303 is capable of receiving a PWM signal, as well as controlling the switching of the power supplier 302 based on the received PWM signal, such that the power output from the power supplier 302 to the LED load 301 can be adjusted, so as to realize dimming of LED 301.

Specifically, the discrete PWM dimming circuit 303 has a main function of PWM switching for the power supplier 302 according to PWM signal, and during the PWM on-time (high level of PWM signal), the power supplier 302 supplies constant current to the LED load 301. During the PWM off-time (low level of PWM signal), there is no power supplied to the LED load 301. As a result, the average current supplied by the power supplier 302 to the LED load 301 can be controlled by the PWM dimming circuit 303 through controlling the switching of the power supplier 302 according to the PWM signal having certain duty ratio.

It is the discrete PWM dimming circuit 303 non-integrated with the power supplier 302 that plays the role of reducing the stand-by power of the lighting apparatus 300 when in a soft turning-off mode of the lighting apparatus 300, since the power supplier 302 is capable of being turned off by the PWM dimming circuit 303 under the control of PWM signal (when PWM=0) (at this moment, the lighting apparatus driver (the power supplier 302 and the discrete PWM dimming circuit 303) may be still being connected to power source), as will be described below in more detail. In one embodiment of present disclosure, power consumption of the power supplier 302 is zero or approaching zero when the PWM signal is zero.

Figure 4:
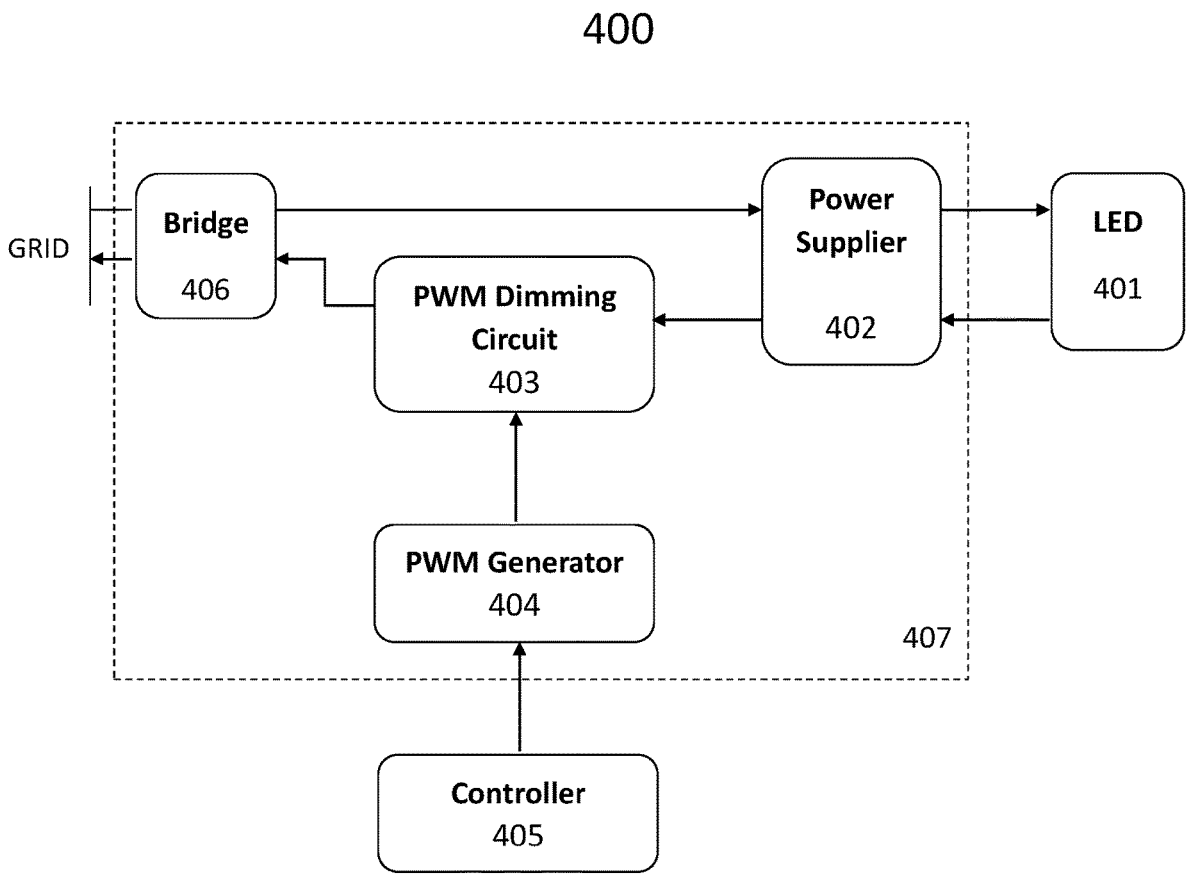
FIG. 4 illustrates another exemplary lighting apparatus 400 to realize PWM dimming for LED in accordance with one embodiment of present invention.

FIG. 4 illustrates another exemplary lighting apparatus 400 to realize PWM dimming for LED in accordance with one embodiment of present invention. Like described with respect to FIG. 3, the exemplary lighting apparatus 400 according to present disclosure shown in FIG. 4 comprises a lighting load 401, and as a non-limiting instance, this lighting load is a LED load 401. The exemplary lighting apparatus 400 also comprises a power supplier 402 that is configured to be connected to the LED load 401, and is to supply power to the LED load 401. A discrete PWM dimming circuit 403, which is connected to the power supplier 402, is also included. The discrete PWM dimming circuit 403 has a main function of PWM switching for the power supplier 402 according to PWM signal.

Similarly, the power supplier 402 in FIG. 4 can be a switching mode power supplier (such as Buck, Buck-Boost, Fly-back, etc), or a linear circuit, or any constant current controlled LED driver that may be used in the field. That is to say, the power supplier is a power regulator (switching regulator or linear regulator, or any other suitable regulator) to provide predetermined power output to the lighting load 401. In a preferred embodiment of the present disclosure, the power supplier 402 is non-PWM-dimmable, i.e., one or more components/circuits used to control PWM dimming for the LED load 401 is not integrated with, or within the circuit of the power supplier 402.

According to one embodiment of the present application, a discrete PWM dimming circuit 403 is used to control PWM dimming for the LED load 401. In other words, the PWM dimming circuit 403 according to present disclosure is separated from (non-integrated with) the power supplier 402. In one embodiment of present disclosure, the dimming circuit 403 may be based on MOSFET or triode, or any other components that can function as a switch circuit to realize PWM switching control of the power supplier 402. In a detailed embodiment of the present application, the dimming circuit 403 may be connected in series with the power supplier 402.

The exemplary lighting apparatus 400 also comprises a PWM generator 404 to generate the PWM signal to the PWM dimming circuit 403. In an embodiment of the present disclosure, the PWM generator can be a MCU, a 2.4G SoC or any other chip which is capable of generating PWM signals. As shown in FIG. 4, the PWM generator 404 is controlled by external control signal issued by a controller 405.

The power supplier 402 and the discrete PWM dimming circuit 403 (and the PWM generator 404) may be collectively regarded as a lighting apparatus driver 407 for the LED load 401. However, this kind of lighting apparatus driver 407 is different from the existing driver for LED which integrates at least the power supplier 402 and the PWM dimming circuit 403 on one single IC or chip.

During working mode of the lighting apparatus 400, the controller 405 external to the lighting apparatus driver 407 may issue a signal/instruction to the PWM generator 404, for example, based on a user instruction, or based on an automatic timing control. According to one embodiment of the present application, the external controller 405 may comprise at least one of: smart phone; smart speaker; in-line digital dimmer; wireless dimmer; IR dimmer; switch, although other forms of controller can be conceived of by one of ordinary skill in the art. □

Then, the PWM generator 404 generates a PWM signal in response to receiving the signal/instruction from the controller 405. In present disclosure, the PWM generator 404 can generate PWM signals having different duty ratios in response to receiving different signals/instructions from the controller 405. The PWM dimming circuit 403 in turn can control the switching of the power supplier 402 based on the PWM signal having certain duty ratio, such that the power output to the LED load 401 can be regulated by the power supplier 402, to reach different brightness levels of LED load 401.

When at working mode indicated by the external control signal issued by the controller 405, the power supplier 402 is to supply predetermined power output with an amplitude being controlled by PWM signal to the LED road 401, as just described. Specifically, the discrete PWM dimming circuit 403 has a main function of PWM switching for the power supplier 402 according to PWM signal, and during the PWM on-time (high level of PWM signal), the power supplier 402 supplies constant current to the LED load 401. During the PWM off-time (low level of PWM signal), there is no power supplied to the LED load 401. As a result, the average current supplied by the power supplier 402 to the LED load 401 can be controlled by the PWM dimming circuit 403 through controlling the switching of the power supplier 402 according to the PWM signal having certain duty ratio.

When at soft turning-off mode indicated by the external control signal issued by the controller 405 (at this time, PWM=0), the power supplier 402 can be turned off by the PWM dimming circuit 403 (at this moment, the lighting apparatus driver 407 (the power supplier 302 and the discrete PWM dimming circuit 403 (and the PWM generator 404)) may be still being connected to power source), and accordingly, power consumption of the power supplier is zero or nearly zero. At this moment, there is no power supplied to the LED load 401 through the power supplier 402, either. In this manner, the stand-by power of the lighting apparatus 400 can be reduced.

One of ordinary skill in the art will appreciate that the controller 405 external to the lighting apparatus driver 407 may communicate with the PWM generator 404 in a wireless way or a wired way, and present disclosure is not intended to limit this.

In addition to the above circuits/components shown in FIG. 4, the lighting apparatus 400 may also comprise some common circuits/components used to support the fundamental function(s) of the lighting apparatus 400, for example, the bridge 406, and other one or more circuits/components to realize filtering, rectification, and so on. However, they are not shown in the Figures, for the purpose of clarity and brevity.

It would also be understood that the signal transfer directions is shown in FIG. 4 for illustration, rather than for limiting.

Figure 5:
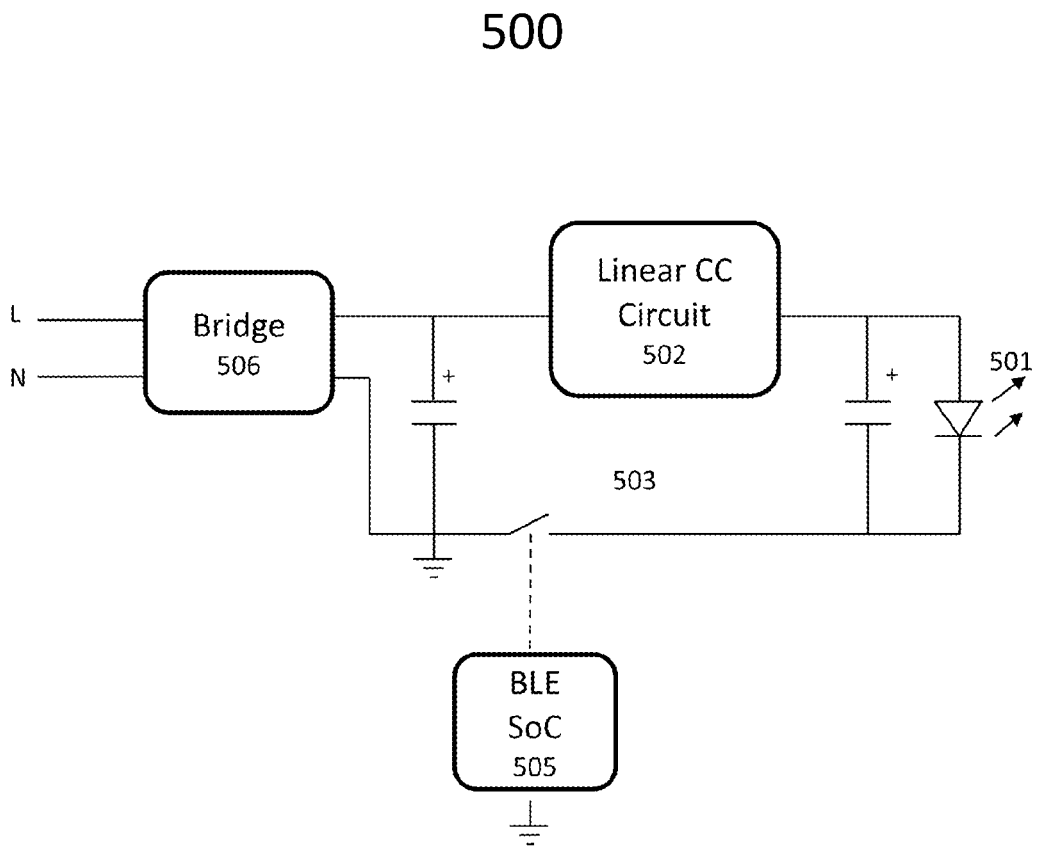
FIG. 5 illustrates still another exemplary lighting apparatus 500 to realize PWM dimming for LED in accordance with one embodiment of present invention.

FIG. 5 illustrates still another exemplary lighting apparatus 500 to realize PWM dimming for LED in accordance with one embodiment of present invention. Like described with respect to FIG. 3 and FIG. 4, the exemplary lighting apparatus 500 according to present disclosure shown in FIG. 5 comprises a lighting load 501, and as a non-limiting instance, this lighting load 501 is a LED load 501. The exemplary lighting apparatus 500 also comprises a power supplier that is configured to be connected to the lighting load 501, and is to supply power to the lighting load 501. In this FIG. 5, the power supplier is embodied as a linear constant current (CC) circuit 502, as an example. A discrete PWM dimming circuit 503, which is connected to the linear constant current (CC) circuit 502, is also included. The discrete PWM dimming circuit 503 has a main function of PWM switching for the CC circuit 502 according to PWM signal.

Although in FIG. 5, the power supplier is embodied as a linear constant current (CC) circuit 502, the present disclosure is not intended to be so limited. Any other suitable power supplier may be contemplated by one of ordinary skill in the art, as listed above with respect to FIG. 3 and FIG. 4. More particularly, the linear CC circuit 502 in FIG. 5 can be replaced by a switching mode power supplier (such as Buck, Buck-Boost, Fly-back, etc), or a linear circuit, or any constant current controlled LED driver that may be used in the field. That is to say, the power supplier can be a power regulator (switching regulator or linear regulator, or any other suitable regulator) to provide predetermined power output to the lighting load 501. In a preferred embodiment of the present disclosure, the power supplier (such as the linear CC circuit 502) is non-PWM-dimmable, i.e., one or more components/circuits used to control PWM dimming for the LED load 501 is not integrated with, or within the circuit of the linear CC circuit 502.

According to one embodiment of the present application, a discrete PWM dimming circuit 503 is used to control PWM dimming for the LED load 501. In other words, the PWM dimming circuit 503 according to present disclosure is separated from (non-integrated with) the linear CC circuit 502. In one embodiment of present disclosure, the dimming circuit 503 may be based on MOSFET or triode, or any other component that can function as a switch circuit to realize the PWM switching control of the linear CC circuit 502. In a detailed embodiment of the present application, the dimming circuit 503 may be connected in series with the linear CC circuit 502.

The exemplary lighting apparatus 500 may also comprise a PWM generator to generate the PWM signal to the PWM dimming circuit 503. In the exemplary embodiment shown in FIG. 5, the PWM generator may be based on a microcontroller unit (MCU) or system on chip (SoC). A MCU-based or SoC-based PWM generator can generate a PWM signal in response to a signal or instruction from user. This PWM signal is then sent to the PWM dimming circuit 503, either in wired way or in wireless way (by using Bluetooth low energy (BLE) as shown in FIG. 5).

The linear CC circuit 502 and the discrete PWM dimming circuit 503 may be collectively regarded as a lighting apparatus driver for the LED load 501. However, this kind of lighting apparatus driver is different from the existing driver for LED which integrates at least the linear CC circuit 502 and the PWM dimming circuit 503 on one single IC or chip.

During working mode of the lighting apparatus 500, the MCU-based or SoC-based PWM generator can generate a PWM signal in response to a signal or instruction. This signal or instruction may come from a user, or may be issued automatically by MCU or SoC itself according to certain timing. Other method of triggering dimming signal or instruction can be contemplated by those skilled in the art. In present disclosure shown in FIG. 5, the MCU-based or SoC-based PWM generator can generate PWM signals having different duty ratios in response to receiving different signals/instructions. The PWM dimming circuit 503 in turn can control the switching of the linear CC circuit 502 based on the PWM signal having certain duty ratio, such that the power output to the LED load 501 can be regulated by the linear CC circuit 502, to reach different brightness levels of LED load 501.

When at working mode indicated by the external control signal, the linear CC circuit 502 is to supply predetermined power output with an amplitude being controlled by PWM signal to LED load 501, as just described. More specifically, the discrete PWM dimming circuit 503 has a main function of PWM switching for the linear CC circuit 502 according to PWM signal, and during the PWM on-time (high level of PWM signal), the linear CC circuit 502 supplies constant current to the LED load 501. During the PWM off-time (low level of PWM signal), there is no power supplied to the LED load 501. As a result, the average current supplied by the linear CC circuit 502 to the LED load 501 can be controlled by the PWM of dimming circuit through controlling the switching of the linear CC circuit 502 according to the PWM signal having certain duty ratio.

When at soft turning-off mode indicated by the external control signal (at this time, PWM=0), the linear CC circuit 502 can be cut off by the PWM dimming circuit 503 (at this moment, the lighting apparatus driver (the linear CC circuit 502 and the discrete PWM dimming circuit 503) may be still being connected to power source), and accordingly, power consumption of the power supplier is zero or nearly zero. At this moment, there is no power supplied to the LED load 501 through linear CC circuit 502, either. In this manner, the stand-by power of the lighting apparatus 500 is reduced.

Also, in addition to the above circuits/components, the lighting apparatus 500 may further comprise some common circuits/components used to support the fundamental function(s) of the lighting apparatus 500, for example, the bridge 506, and other one or more circuits/components to realize filtering, rectification, and so on. However, they are not shown in the Figures, for the purpose of clarity and brevity.

In present disclosure, lighting apparatus comprises a non-dimmable circuit to supply constant current for LED load. For example, the power supplier 302 in FIG. 3, the power supplier 402 in FIG. 4, or the linear constant current circuit 502, which supply constant current for respective LED loads, are all non-dimmable, instead, the dimming control is realized by a discrete PWM dimming circuit, for example, the PWM dimming circuits 303, 403, 503 shown respectively in FIGS. 3-5. In present disclosure, discrete PWM dimming circuit primarily means that this PWM dimming circuit is non-integrated with the above mentioned various non-dimmable power suppliers. In a further embodiment of the present disclosure, the PWM dimming circuit may be connected in series with the power supplier circuit.

In present disclosure, during soft turning-off mode of the lighting apparatus, the power supplier circuit can be totally cut off by the discrete PWM dimming circuit, such that the standby power of the power supplier circuit is zero or nearly zero. In present application, the power supplier is capable of being cut off by the dimming circuit when the lighting apparatus driver is still being connected to power source. In this manner, the power consumption of whole lighting apparatus can be reduced.

In addition, in present disclosure, there are only a few components in dimming circuit to have PWM dimming function achieved. At the same time, a simple constant current power supplier can be used in the lighting apparatus in present disclosure. Therefore, the BOM cost is low. Compared to the existing PWM dimming IC circuit (with at least PWM dimming function integrated thereon), BOM cost of the circuitry constructed as in present disclosure can be reduced by about 50%, or even 75%.

Since "green" electrical apparatus has been more and more frequently expected and proposed in recent years, the circuitry constructed in present disclosure would be good to the customers as well as the environment.

It is to be noted that, although the embodiments of present invention as described above are mainly aiming at a LED load, the spirit and concept of present invention can be applying to any other suitable lighting load, to reduce the BOM cost and stand-by power of the lightening apparatus. It is should be also noted that, although the embodiments of present invention as described above are mainly aiming at PWM diming approach, the spirit and concept of present invention can be applying to any other suitable dimming method, to reduce the BOM cost and stand-by power of the lightening apparatus.

It will also be appreciated, although the exemplary lighting apparatus are illustrated in the embodiments of FIGS. 3-5 as individual circuitry, it does not mean the circuitry of lighting apparatus are irrelevant to each other. Some components or circuits in different embodiments can be interchangeably used, or can be separated or integrated, as long as this kind of modification is within the concept of present disclosure.

For brevity and clarity, the embodiments of present disclosure only introduce some essential circuits/components which can generally present the invention sprit. However, those skilled in the art would understand that other circuit/components can be added, or some circuit/components can be removed from the illustrated embodiments, as long as this kind of modification is within the concept of present disclosure.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. A lighting apparatus driver, comprising:

a power supplier connected to a power source to supply power to a lighting load;

a discrete pulse width modulation (PWM) dimming circuit to receive a PWM signal to control the switching of the power supplier based on the PWM signal, and a PWM generator to generate the PWM signal and send the PWM signal to the PWM dimming circuit;

wherein the power supplier is capable of being cut off by the PWM dimming circuit while the lighting apparatus driver is still operably connected to the power source; and wherein the PWM dimming circuit is not integrated with or within the circuit of the power supplier such that at least the PWM dimming circuit remains connected to the power source when the power supplier is cut off by the PWM dimming circuit.

2. The lighting apparatus driver as recited in claim 1, wherein the power supplier is non-PWM-dimmable.

3. The lighting apparatus driver as recited in claim 1, wherein the dimming circuit is connected in series with the power supplier.

4. The lighting apparatus driver as recited in claim 1, wherein power consumption of the power supplier is zero when the PWM signal is zero.

5. The lighting apparatus driver as recited in claim 1, wherein the power supplier is to be cut off by the dimming circuit when the PWM signal is zero or approaching zero.

6. The lighting apparatus driver as recited in claim 1, wherein the power supplier is a power regulator to provide predetermined power output to the lighting load.

7. The lighting apparatus driver as recited in claim 6, wherein the power supplier comprises at least one of:

switching regulator; and linear regulator.

8. The lighting apparatus driver as recited in claim 1, wherein the dimming circuit is based on Metal Oxide Semiconductor Field Effect Transistor (MOSFET) or triode.

9. The lighting apparatus driver as recited in claim 1, wherein during the PWM on-time when it sends off high level of PWM signal, the power supplier supplies constant current to the LED load.

10. The lighting apparatus driver as recited in claim 1, wherein the PWM generator is controlled by external control signal issued by a controller external to the lighting apparatus driver.

11. The lighting apparatus driver as recited in claim 10, wherein during working mode indicated by the external control signal, the power supplier is to supply predetermined power output with an amplitude being controlled by PWM signal to the lighting load; and during soft turning-off mode indicated by the external control signal, the power supplier is to be cut off by the dimming circuit, such that the power consumption of the power supplier is zero.

12. The lighting apparatus driver as recited in claim 10, wherein the external controller comprises at least one of:

smart phone;

smart speaker;

in-line digital dimmer;

wireless dimmer;

IR dimmer; and switch.

13. The lighting apparatus driver as recited in claim 1, wherein the PWM generator is based on microcontroller unit (MCU) or system on chip (SoC).

14. The lighting apparatus driver as recited in claim 1, wherein the discrete PWM dimming circuit is based on discrete components non-integrated with the power supplier.

15. A lighting apparatus driver, comprising:

a power supplier connected to a power source to supply power to a lighting load;

a discrete dimming circuit to receive a dimming input signal to control the switching of the power supplier based on the dimming input signal, and a PWM generator to generate the dimming input signal and send the dimming input signal to the discrete dimming circuit;

wherein the power supplier is capable of being cut off by the dimming circuit while the lighting apparatus driver is still operably connected to the power source; and wherein the discrete dimming circuit is not integrated with or within the circuit of the power supplier such that at least the PWM dimming circuit remains operably connected to the power source when the power supplier is cut off by the PWM dimming circuit.

16. The lighting apparatus driver as recited in claim 15, wherein the power supplier is non-dimmable.

17. The lighting apparatus driver as recited in claim 15, wherein the dimming circuit is connected in series with the power supplier.

18. The lighting apparatus driver as recited in claim 15, wherein power consumption of the power supplier is zero when the dimming input signal is zero or approaching zero.

19. The lighting apparatus driver as recited in claim 15, wherein the dimming circuit is a PWM dimming circuit.

20. The lighting apparatus driver as recited in claim 15, wherein the dimming circuit is based on Metal Oxide Semiconductor Field Effect Transistor (MOSFET) or triode.

* * * * *